US006247596B1

(12) United States Patent
Muyskens

(10) Patent No.: US 6,247,596 B1
(45) Date of Patent: Jun. 19, 2001

(54) SPRING LOADED CORNER POST FOR USE WITH PLASTIC FILM WRAPPING

(75) Inventor: David B. Muyskens, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/502,218

(22) Filed: Feb. 11, 2000

(51) Int. Cl.[7] ..... B65D 81/02
(52) U.S. Cl. ..... 206/586; 206/591; 206/497
(58) Field of Search ..... 206/586, 591, 206/592, 593, 594, 453, 497

(56) References Cited

U.S. PATENT DOCUMENTS

| | | | |
|---|---|---|---|
| 1,821,692 | 9/1931 | Copeland . | |
| 3,086,689 | 4/1963 | Wiedenmeier . | |
| 3,244,347 | 4/1966 | Jenk . | |
| 3,734,389 | 5/1973 | Brown . | |
| 3,891,086 | 6/1975 | Isaacs . | |
| 3,946,868 | 3/1976 | Rutter . | |
| 4,202,449 | 5/1980 | Bendt . | |
| 4,244,471 | 1/1981 | Plante . | |
| 4,482,054 | 11/1984 | Gardner . | |
| 4,483,444 | 11/1984 | Gardner . | |
| 4,771,893 | 9/1988 | Liebel . | |
| 5,267,651 | 12/1993 | Hughes . | |
| 5,277,310 | 1/1994 | Mertz . | |
| 5,593,039 | 1/1997 | Ortlieb . | |
| 5,813,537 | 9/1998 | DeReu et al. . | |
| 6,059,104 * | 5/2000 | Widman | 206/586 |

* cited by examiner

*Primary Examiner*—Shian Luong
(74) *Attorney, Agent, or Firm*—Bullwinkel Partners, Ltd.

(57) ABSTRACT

A corner post for protecting and cushioning large products such as appliances that compresses to a stronger shape than its original shape when the corner post and product are wrapped in clear plastic film. The corner post comprises beads formed along the vertical lengths of the inner and outer walls. When wrapped in plastic film, the beads lock together to form a stable structure that resists further compression while exerting an outward force on the plastic film to insure that the plastic film stays tight during shipping and storage.

5 Claims, 2 Drawing Sheets

FIG. 3
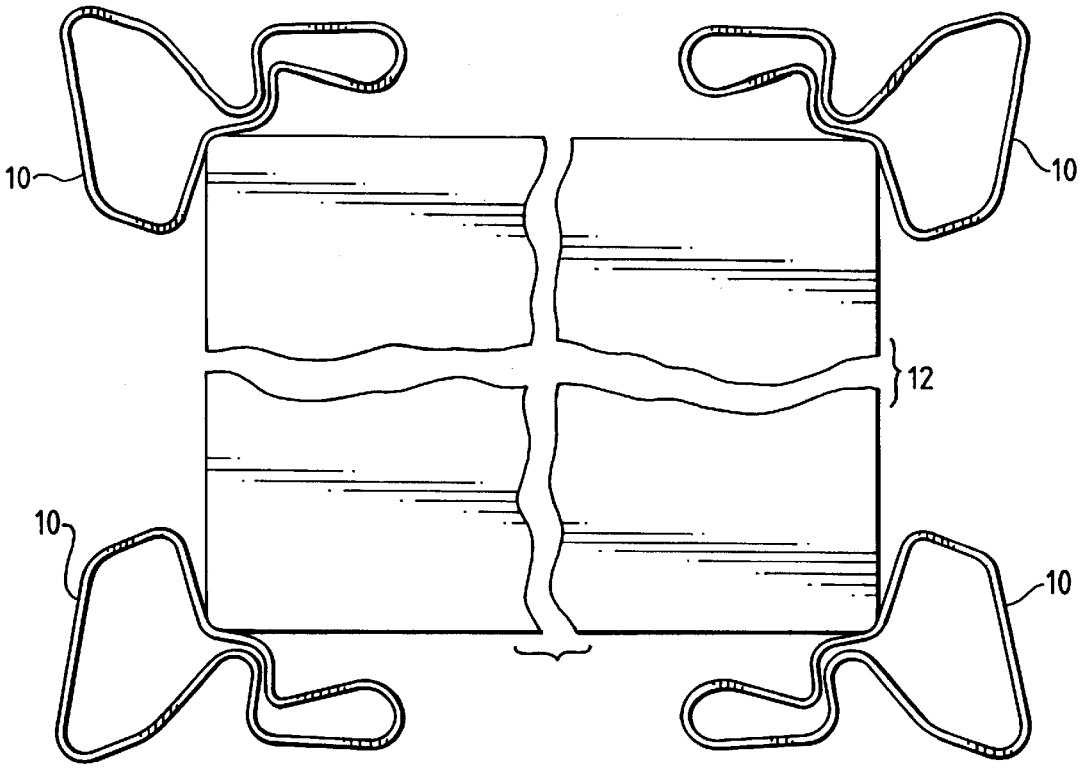
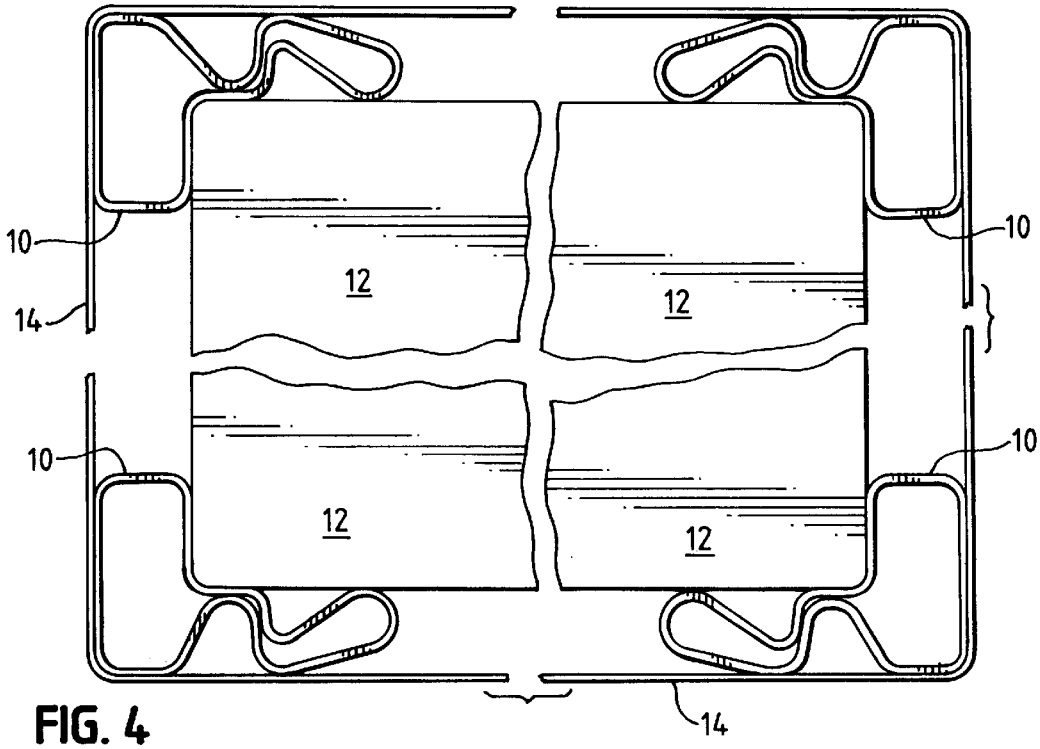
FIG. 4

SPRING LOADED CORNER POST FOR USE WITH PLASTIC FILM WRAPPING

BACKGROUND

1. Field of the Invention

This patent relates to packaging for large appliances such as washers, dryers and refrigerators. More particularly, this patent relates to an improved tubular-type corner post that flexes when wrapped tightly with plastic film but is "spring loaded" in the sense that, when fully compressed, it imparts an outward force on the plastic film to keep the plastic film tight.

2. Description of the Related Art

Corner posts are used to cushion the corners of large, heavy appliances (such as washers, dryers, refrigerators, dishwashers and stoves) during storage and transport and to provide resistance against axially directed compressive loads. Typically, the appliance is placed on and fastened to a base pad having dimensions greater than the width and length (depth) of the appliance to accommodate the corner posts. A protective corrugated sleeve is placed over the appliance and inside the perimeter of the base to form four container sidewalls. The corner posts are then inserted around the corners of the appliance to protect the product from scratching and denting during shipping and handling. A corrugated top serves as the container lid. Metal or plastic straps may be wrapped around the container to better secure the corner posts between the appliance corners and the corrugated container walls.

One typical type of corner post is that made of multiple layers of paper wound into a convolute (coiled) tube. Adhesive is used to bond the paper layers. Before the adhesive dries, the tube is formed into the desired shape, typically one with a modified "L" shaped cross section to fit snugly between the corner of an appliance and the inner corner of the appliance container.

Numerous patents disclose corner posts made from convolutely wound paper. For example, Gardner U.S. Pat. No. 4,482,054, issued Dec. 7, 1993, discloses a corner post made of a single piece of convolutely wound paper having fibers disposed longitudinally. Numerous beaded configurations are disclosed.

Ortlieb U.S. Pat. No. 5,593,039 discloses a corner post made from convolutely wound paper and including a shoulder defined by a laterally turned portion of an inner wall. The corner post is designed to be used with appliances having projecting handles and the like.

Hughes U.S. Pat. No. 5,267,651, issued Dec. 7, 1993, discloses yet another corner post made from convolutely wound paper. Stiffening beads in each leg and integrally formed in the outside wall extend into free engagement with the inner wall. When a transverse force is applied to one leg of the post, the stiffening bead in that leg partially collapses on itself and slides along the inner wall.

While these and other corner posts are most often used to cushion and protect appliances packaged in cartons having vertical walls made of corrugated cardboard, they can also be used with packages employing heavy duty clear plastic film. The plastic film then serves as the sides of the package. The resulting package allows a substantially full view of the appliance.

However, one disadvantage of using conventional corner posts with plastic film packages is that, when the corner posts are placed around the corners of a product and the entire assembly is wrapped tightly in clear plastic film, the film tends to become loose over time. A second disadvantage of conventional tubular type corner posts is that they can collapse when subjected to very strong compressive forces, such as that which is applied when an appliance package is wrapped very tightly in plastic film.

Thus it is an object of the present invention to provide a corner post that can be used to protect products wrapped tightly in plastic film.

Another object of the present invention is to provide a spring loaded corner post that exerts an outward force on the plastic film when in a compressed state so that the plastic wrap stays tight during shipping and storage.

Yet another object of the present invention is to provide a corner post that does not collapse or lose its protective ability when subjected to compressive forces from tightly wrapped plastic film.

Still another object of the present invention is to provide a corner post whose strength is enhanced when it is wrapped tightly with plastic film.

Further and additional objects will appear from the description, accompanying drawings, and appended claims.

SUMMARY OF THE INVENTION

The present invention is a spring loaded corner post for cushioning and protecting a product to be wrapped very tightly in clear plastic film. When corner posts made according to the present invention are placed around a product and the assembly is wrapped tightly in clear plastic film, the corner posts flex until they cannot flex any more, at which point the corner posts exert an outward force on the plastic film in "spring loaded" fashion, thus keeping the plastic film tight.

The corner post comprises an outer wall having two leg members connected lengthwise along an outer corner and an inner wall having two leg members connected lengthwise along an inner corner. The inner wall leg members are substantially coextensive with the outer wall leg members. The inner and outer walls are laterally spaced from one another and define spaces therebetween. Formed integrally along one leg of the inner wall and running the length of the wall is a first bead or indentation. The bead has two side panels which extend from the inner wall toward the outer wall and terminate in an apex.

A second bead is integrally formed in the outer wall along its length. This second bead has two side panels extending toward the inner wall and terminating in an apex. The second bead apex is spaced from the inner wall.

The first and second beads are formed along corresponding legs of the inner and outer walls but are offset to allow the corner post to be compressed slightly when subjected to a compressive force, such as when the product and corner post assembly is wrapped tightly in clear plastic film.

When the product and corner post assembly is wrapped tightly in plastic film, a side panel of the second (outer) bead is forced against a side panel of the first (inner) bead, and the second bead apex is forced against the inner wall, thus "locking" the two beads together to prevent further compression. Preferably, the side panels are substantially parallel and extend at acute angles from the inner and outer walls respectively.

In the preferred embodiment, the outer wall leg members form an outer corner which defines an acute angle. When wrapped very tightly in plastic film, this outer corner approaches a right angle. The distortion of the outer and inner walls causes the walls to exert an outward force on the plastic film, thus keeping the plastic film tightly wrapped around the product and corner post assembly.

THE DRAWINGS

FIG. 3 is a top plan view of a product and corner post assembly according to the present invention before being wrapped tightly in plastic film.

FIG. 4 is a top plan view of a product and corner post assembly according to the present invention after being wrapped tightly in plastic film.

DETAILED DESCRIPTION OF THE INVENTION

The present invention is a spring loaded corner post for protecting and cushioning products, including large products such as appliances, during shipping, storage and handling. The corner post is designed to cover the corners of the product, and compresses to a stronger shape than its original shape when the product and corner post assembly is wrapped tightly in clear plastic film. The corner post is said to be spring loaded because, when compressed, it exerts an outward tension on the plastic film to insure that the plastic film stays tight during shipping and storage. Thus the present invention offers an excellent framework for both heat and non-heat application of the plastic film.

Figure 1:
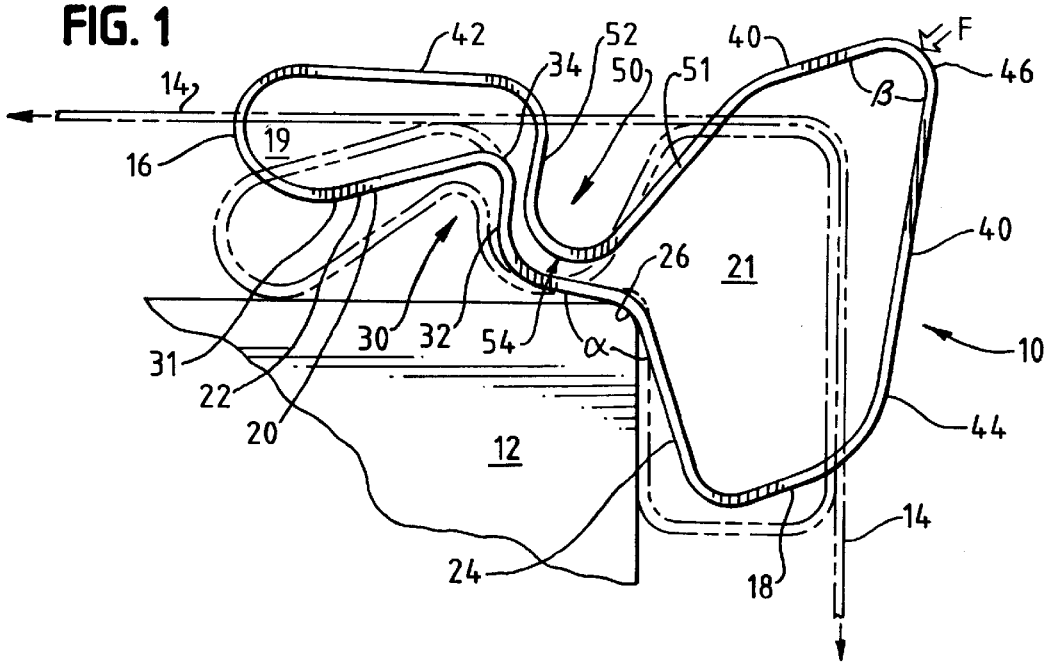
FIG. 1 is a top plan view of the corner post of the present invention shown in relation to a product before and after plastic film is wrapped tightly around the product and corner post.
Figure 2:
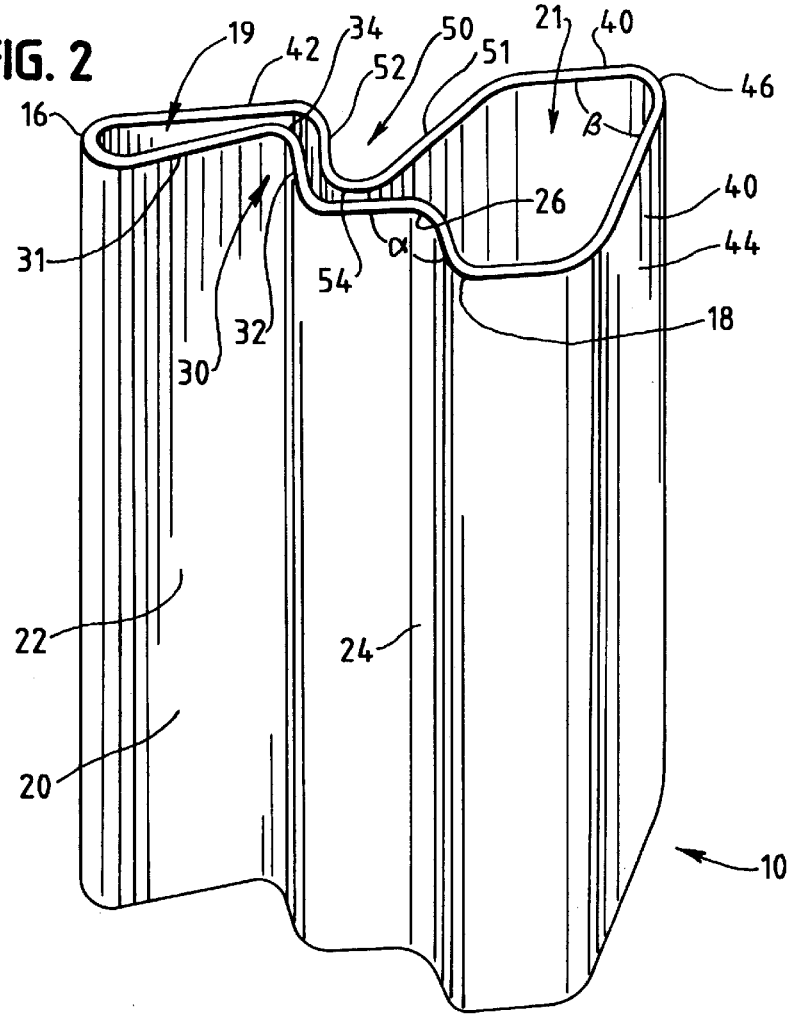
FIG. 2 is a perspective view of the corner post of the present invention shown in relation to a product before the corner post and product are wrapped tightly in plastic film, the product shown in phantom lines.

Turning to the drawings, FIG. 1 shows a top plan view of a spring loaded corner post 10 made according to the present invention, shown in relation to a product 12 both before and after being wrapped tightly in plastic film 14. FIG. 2 shows a perspective view of the same corner post 10 before being wrapped tightly in plastic film 14, with the product 12 shown in phantom lines.

The corner post 10 comprises an inner wall 20 on the side toward the product 12 and an outer wall 40 on the side away from the product 12. The inner and outer walls 20, 40 are joined at opposing ends 16, 18 to define hollow areas 19, 21 between the walls 20, 40.

The inner wall 20 comprises a pair of legs or wall members 22, 24 which meet along their vertical length to define an inner corner 26. Inner corner 26 abuts the corner of the product 12. The angle formed by the inner wall members 22, 24 is indicated in FIGS. 1 and 2 as $\alpha$.

Likewise, the outer wall 40 comprises a pair of legs or wall members 42, 44 which meet along their vertical length to define an outer corner 46 away from the product 12. The angle formed by the outer wall members 42, 44 is indicated in FIGS. 1 and 2 as $\beta$.

A key aspect of the invention is a pair of offset beads 30, 50 which lock together when the corner post is wrapped tightly in plastic film to prevent the corner post 10 from collapsing and helps exert outward pressure on the plastic film. A first, or inner, bead 30 is formed vertically along one inner wall member 22 and extends away from the product 12 and toward the corresponding outer wall member 42. This inner bead 30 comprises opposed side panels 31, 32 joined along an apex 34.

A second, or outer, bead 50 is formed vertically along the corresponding outer wall member 42 and extends toward the product 12 and toward the inner wall member 22. The outer bead 50 comprises opposed side panels 51, 52 joined along an apex 54. Preferably, the apex 54 is spaced from the inner wall 20. In the preferred embodiment, the side of the outer bead 50 farthest from the outer corner 46 forms an acute angle with the outer wall member 42.

The inner and outer beads 30, 50 are offset from each other to allow the corner post 10 to compress and deform when the corner post 10 is wrapped tightly in plastic film 14. Specifically, the inner bead 30 is closer to the end 16 of the corner post 10 than the outer bead 50.

The invention may be used in the following manner. First, the product is placed on a pallet large enough to accommodate the product and the corner posts. Next, the corner posts are placed around the product so that one corner post protects each product corner. Finally, plastic film is wrapped tightly around the product and corner post assembly to create a clear, firm package.

Prior to the product and corner post assembly being wrapped in plastic film 14, the configuration of the corner post 10 is as shown in solid lines in FIG. 1 as well as in FIG. 2. The inner wall members 22, 24 do not lie flat against the corresponding sides of the product 12 near the inner wall corner 26. Thus the angle $\alpha$ formed by the two inner wall members 22, 24 is slightly greater than ninety degrees. The angle $\beta$ formed by the two outer wall members 42, 44 is less than 90 degrees. The cross-sectional shape formed by the outer wall 40 and the inner wall 20 surrounding the large hollow area 21 approximates that of a parallelogram.

When the product and corner post assembly is wrapped tightly in plastic film, the plastic film exerts a force on the corner post 10 in a direction approximately normal to the outer wall corner 46, as indicated by F in FIG. 1. This force F causes the corner post 10 to deflect or compress to a shape approximating that shown in phantom line in FIG. 1.

When force F is applied by the plastic film 14, the outer wall 40 deflects inwardly toward the product 12. In practice it has been found that portions of the outer wall 40 can deflect ⅛ to ½ inch or more when wrapped in clear plastic film. The inner wall 20 also deflects inwardly toward the product 12, although usually to a lesser extent.

One end 16 of the corner post 10, referred to as the knob, deflects slightly, but preferably not so much that it comes in contact with the side of the product 12. The other end 18 of the corner post 10 deflects slightly until it either makes or almost makes contact with the product 10, as shown in the phantom line in FIG. 1.

As the corner post 10 deflects in response to pressure from the plastic film 14, the cross-sectional shape formed by the outer wall 40 and the inner wall 20 surrounding the large hollow area 21 approaches that of a rectangle. The angle $\alpha$ formed by the two inner wall members 22, 24 and the angle $\beta$ formed by the two outer wall members 42, 44 both approach ninety degrees. Since the corner post 10 resists distortion, it tries to assume its original, noncompressed shape. In doing so, the corner post 10 exerts an outward force on the plastic film 14, thus helping to maintain the plastic film in a taut state.

As the outer wall 40 moves inward, the outer bead 50 moves inward toward the inner wall 20 and to a lesser extent laterally toward the inner bead 30. When the corner post 10 is fully compressed, the outer bead side panel 52 farthest away from the outer corner 46 abuts the inner bead side panel 32 nearest the inner corner 26, and the outer bead apex 54 abuts the inner wall 20, thus "locking" the two beads 30, 50 together. Once fully compressed, the interlocked beads

30, 50 resist further compression, and also act like a spring to help maintain tension on the plastic film 14, keeping it tightly wrapped around the product and corner post assembly.

The deflection of the corner post 10 from an uncompressed (relaxed) state to a compressed state as a result of being wrapped in plastic film 30 results in a post 10 that not only resists further compression, but actually exerts an outward force on the plastic film 30. In other words, when subjected to a strong compressive force such as that caused by tightly wrapped plastic film, the corner post 10 of the present invention flexes until it cannot flex any more, at which point it exerts an outward force on the plastic film 16, whether the plastic film has been applied with heat or without heat.

Preferably, the inner bead side panel 32 nearest the inner corner 26 and the outer bead side panel away from the outer corner 46 are substantially parallel and extend at acute angles from the inner and outer walls respectively. Alternatively, one or both side panels may be substantially perpendicular to the corner post walls, but some loss in stability may result.

FIG. 3 shows a top plan view of a product 12, illustrating the position of the corner posts 10 before plastic film 14 is wrapped around the corner posts 10 and product 12. The corner posts are all similar in shape to that shown in FIG. 1.

FIG. 4 shows a top plan view of the product 12 and corner posts 10 of FIG. 3 after plastic film 14 has been wrapped tightly around the assembled corner posts 10 and product 12. Each corner post 10 has been compressed and exerts an outward force on the plastic film 14.

Thus the present invention provides a spring loaded corner post that does not lose its protective and cushioning ability when subjected to pressure from tightly wrapped plastic film and which provides integrity to the plastic wrap by maintaining an outward tension on the plastic film so that the plastic film stays tight during shipping and storage.

It will be appreciated that other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A corner post for cushioning and protecting a product, said corner post comprising:

an outer wall having two leg members connected lengthwise along an outer corner;

an inner wall substantially coextensive with said outer wall, the inner and outer walls being laterally spaced from one another and joined at opposing ends to define a space therebetween;

a first bead integrally defined by the inner wall along the length of the inner wall and having side panels extending from the inner wall toward the outer wall and terminating in an apex, said apex being spaced from said outer wall; and a second bead integrally defined by the outer wall along the length of the outer wall and having side panels extending toward the inner wall and terminating in an apex, said second bead apex being spaced from the inner wall, said second bead being slightly offset from said first bead such that, when the corner post is placed adjacent to an exterior corner of the product and the outer wall is subjected to a compressive force of sufficient magnitude approximately normal to the outer corner, the second bead moves into abutting relationship with the inner wall and the first bead.

2. The corner post of claim 1 wherein, when the corner post is placed adjacent to an exterior corner of the product and the outer wall is subjected to a compressive force of sufficient magnitude approximately normal to the outer corner, one of the second bead side panels abuts one of the first bead side panels and the second bead apex abuts the inner wall.

3. The corner post of claim 1 wherein, prior to the outer wall being subjected to the compressive force, the outer corner defines an acute angle.

4. The corner post of claim 3 wherein, when the corner post is placed adjacent to an exterior corner of the product and the outer wall is subjected to the compressive force, the angle formed by the outer wall leg members approaches ninety degrees.

5. A spring loaded corner post for cushioning and protecting a product, said corner post comprising:

an outer wall comprising first and second wall members joined along a vertical edge to define an outer corner;

an inner wall comprising first and second wall members substantially coextensive with said outer wall first and second wall members and joined along a vertical edge to form an inner corner, the first inner and outer wall members being laterally spaced from one another and joined at a first end, the second inner and outer wall members being laterally spaced from one another and joined at a second end, the inner and outer walls being spaced from each other to define a space therebetween;

an inner bead integrally defined by the first inner wall member along the vertical length of the first inner wall member and having opposed side panels extending from the first inner wall member and joined along an apex, said apex spaced from said first outer wall member; and an outer bead integrally defined by the first outer wall member along the vertical length of the first outer wall member and having opposed side panels extending from the first outer wall member and joined at an apex, said outer bead apex spaced from the first inner wall member, said inner and outer beads being offset such that the inner bead is nearer the first end than the outer bead;

wherein when the corner post is placed adjacent to an exterior corner of the product and wrapped tightly in plastic film, the outer bead side panel nearest the first end abuts the inner bead side panel away from the first end, and the outer bead apex abuts the inner wall first member.

* * * * *